US008191652B2

(12) United States Patent
Kotsonis et al.

(10) Patent No.: US 8,191,652 B2
(45) Date of Patent: Jun. 5, 2012

(54) DIRECTIONAL CONTROL DRILLING SYSTEM

(75) Inventors: Spyro Kotsonis, Missouri City, TX (US); Cedric Perrin, Forcelles Saint Gorgon (FR); Eric Lavrut, Yokohama (JP); Henri Denoix, Chatenay Malabry (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 503 days.

(21) Appl. No.: 12/301,273

(22) PCT Filed: May 11, 2007

(86) PCT No.: PCT/EP2007/004271

§ 371 (c)(1), (2), (4) Date: Apr. 24, 2009

(87) PCT Pub. No.: WO2007/134748

PCT Pub. Date: Nov. 29, 2007

(65) Prior Publication Data

US 2010/0025115 A1 Feb. 4, 2010

(30) Foreign Application Priority Data

May 19, 2006 (EP) ..... 06290840

(51) Int. Cl.
*E21B 7/08* (2006.01)
*E21B 4/18* (2006.01)

(52) U.S. Cl. ..... 175/61; 175/97; 166/117.6

(58) Field of Classification Search ..... 175/61, 175/62, 92, 93, 94, 97, 104; 166/117.5, 117.6
See application file for complete search history.

(56) References Cited

U.S. PATENT DOCUMENTS

| | | | | | |
|---|---|---|---|---|---|
| 4,396,073 | A | * | 8/1983 | Reichman et al. | 175/74 |
| 4,463,814 | A | * | 8/1984 | Horstmeyer et al. | 175/45 |
| 5,002,138 | A | * | 3/1991 | Smet | 175/45 |
| 5,148,875 | A | * | 9/1992 | Karlsson et al. | 175/62 |
| 5,394,951 | A | * | 3/1995 | Pringle et al. | 175/61 |
| 5,425,419 | A | * | 6/1995 | Sieber | 166/206 |
| 6,092,160 | A | | 7/2000 | Marsters | |
| 6,092,610 | A | * | 7/2000 | Kosmala et al. | 175/61 |
| 6,158,529 | A | * | 12/2000 | Dorel | 175/61 |
| 6,216,802 | B1 | | 4/2001 | Sawyer | |
| 6,923,273 | B2 | * | 8/2005 | Terry et al. | 175/45 |
| 7,537,055 | B2 | * | 5/2009 | Head et al. | 166/298 |
| 2001/0022241 | A1 | | 9/2001 | Portman et al. | |

FOREIGN PATENT DOCUMENTS

| | | |
|---|---|---|
| EP | 0110182 | 6/1984 |
| EP | 0911483 | 4/1999 |
| EP | 0911483 | 8/2006 |
| EP | 1640556 | 6/2008 |
| EP | 1365103 | 10/2008 |
| GB | 2417740 | 3/2006 |
| WO | 2004072437 | 8/2004 |

* cited by examiner

*Primary Examiner* — Kenneth L Thompson
(74) *Attorney, Agent, or Firm* — Stephanie Chi; Matthias Abrell; Charlotte Rutherford

(57) ABSTRACT

A drilling system, comprising a non-rotating conveyance system; a tool connected to the non-rotating conveyance system and including anchors by which the tool can be anchored in position when located in a borehole; a drill bit connected to the tool; a motor for rotating the drill bit; and a directional control system interposed between the tool and the drill bit; wherein, in use, whit the drilling system located in a borehole, the directional control system can be operates so as to displace the drill bit away from the axis of the borehole.

16 Claims, 8 Drawing Sheets

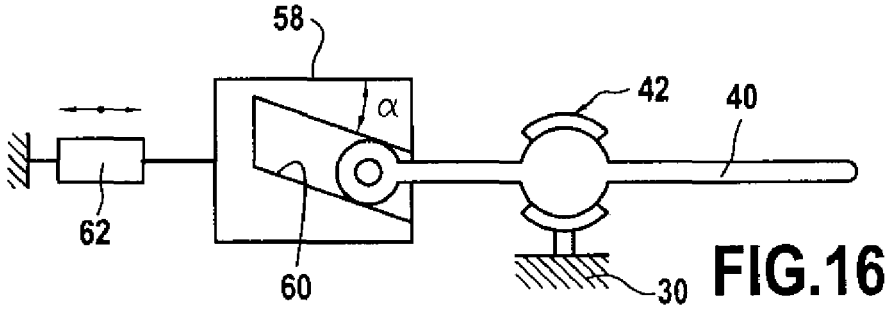
FIG.16
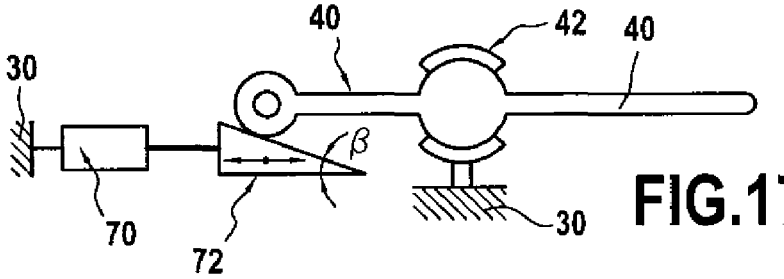
FIG.17
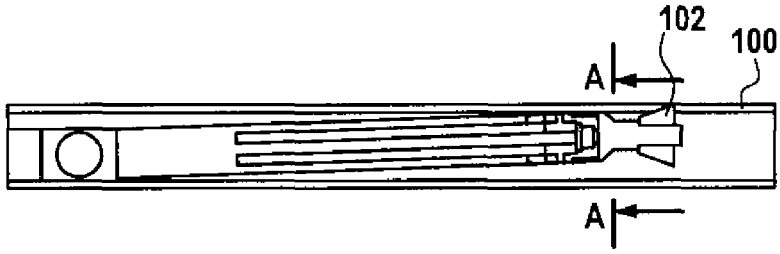
FIG.18
FIG.19
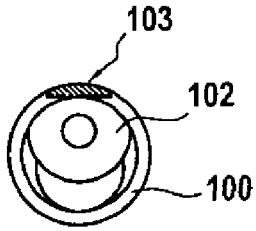
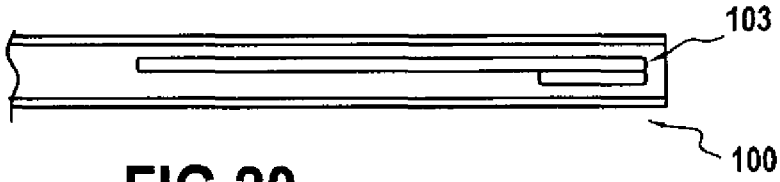
FIG.20

DIRECTIONAL CONTROL DRILLING SYSTEM

FIELD OF THE INVENTION

This invention relates to drilling systems suitable for drilling underground boreholes. In particular, the invention relates to such drilling systems that allow the trajectory of the borehole to be controlled and deviated as drilling progresses by controlling the direction in which the system drills.

BACKGROUND OF THE INVENTION

In the process of drilling underground boreholes, one of the important factors affecting the success of the job is the time spent steering the well in the right direction and landing properly. Frequent changes in trajectory lead to increased hole tortuosity that increases the force required to run in and out of the hole, and also increases the total distance that needs to be drilled to get to the same target.

Drilling using a wireline cable from the bottom-hole drilling assembly (BHA) to the surface offers many benefits in terms of reduction of cost-of-drilling, and reduction of assets and personnel on location. However, with these comes a reduction in the available power available for drilling. An example of such a system can be found in one described in WO 2004072437 A (SERVICES PETROLIERS SCHLUMBERGER ET AL) Aug. 26, 2004. Such systems typically have separate drive systems for axial drive (thrust, WOB) and rotation of drill bit.

This decrease in power creates the need to optimize the drilling process by applying a lower-than-conventional force and torque at the bit, and also being able to control the rate of penetration (ROP) or advancement in real time.

Conventional drilling mainly employs two steering mechanisms; surface adjustable motor housings and rotary steerable assemblies (see, for example, U.S. Pat. No. 6,092,610 (SCHLUMBERGER TECHNOLOGY CORPORATION) Jul. 25, 2000, but neither are considered as a good match for a low power non-rotating tool. A surface adjustable housing requires multiple trips, increasing total time spent on a well and increasing tortuosity. Rotary steerable tools rely on the tool rotating for the steering mechanism.

The present invention aims to provide a drilling system that can control the direction of drilling when used with a non-rotating conveyance such as a wireline cable or coiled tubing. In the context of this invention, a non-rotating conveyance is one which cannot be used to transmit rotation along the well to a downhole drilling assembly.

SUMMARY OF INVENTION

In an embodiment, this invention provides a well service system having a non-rotating conveyance system; a tool connected to the non-rotating conveyance system and including anchors by which the tool can be anchored in position when located in a borehole; a changeable operating head connected to the tool; a motor for rotating the changeable operating head; and a directional control system interposed between the tool and the changeable operating head; wherein, in use, with the system located in a borehole, the directional control system can be operated so as to displace the changeable operating head away from the axis of the borehole to perform various operations at the well wall or casing.

The well service system may comprise a drilling system, wherein the operating head has a drill bit. The operating head may also comprise a casing milling tool, or a system to set a deflector or whipstock for guiding tools into a lateral borehole.

In an embodiment, the directional control system comprises at least three skids positioned between the tool and the operating head, each skid projecting in a radial direction by an adjustable amount; the projection of each skid being adjusted in use to contact the wall of the borehole and displace the operating head in a desired direction. The skids are preferably shaped at their out ends so as to be able to slide along the borehole wall during use.

In such an embodiment, the operating head and skids are preferably separated from the tool by a flex section.

In another embodiment, the directional control system comprises a universal joint in the tool through which the operating head is connected, and a direction control mechanism in the tool which is operable to adjust the angle of the operating head axis relative to the tool axis and to adjust the azimuthal direction of the operating head axis.

Preferably, a shaft extends between the operating head and the direction control mechanism through the universal joint.

An embodiment of the direction control mechanism comprises a pair of inter-engaging eccentric rings, one of which connects to the tool and the other of which connects to the shaft, relative rotation of the rings allowing adjustment of the angle of the operating head axis, and co-rotation allowing adjustment of the azimuthal direction of the operating head axis. In a particularly preferred arrangement, a first, outer ring is connected to the tool, and a second, inner ring that sits inside the first ring and is connected to the shaft.

In a second embodiment, the direction control mechanism comprises at least three pistons which act on a head connected to the shaft, the pistons being operable to adjust the angle of the operating head axis relative to the tool axis and to adjust the azimuthal direction of the operating head axis.

In a variant of this second embodiment, the pistons act in a radial direction to adjust the position of the shaft.

In a third embodiment, the direction control mechanism comprises at least three inflatable bladders positioned inside the tool around the shaft, the bladders being inflatable so as to act on the shaft and adjust its position.

The motor for rotating the operating head is preferably positioned between the operating head and the tool.

Preferably, the direction control mechanism comprises separate mechanisms for control of rotation and translation respectively.

Typically, the tool comprises an axial drive system for applying thrust to the operating head. A preferred form of axial drive system is a push-pull tractor having pairs of anchors that are alternately deployed as the tractor moves along the borehole. The tractor anchors can provide the anchors by which the tool is located in position in the borehole.

The non-rotating conveyance system can comprise, for example, a wireline cable or coiled tubing.

The concepts of this invention can apply broadly to a well service system, comprising a non-rotating conveyance system; a tool connected to the non-rotating conveyance system and including anchors by which the tool can be anchored in position when located in a borehole; a changeable operating head (drill bit, hone, jet head, etc.) connected to the tool; a motor for rotating the changeable operating head; and a directional control system interposed between the tool and the changeable operating head; wherein, in use, with the system located in a borehole, the directional control system can be operated so as to displace the changeable operating head away from the axis of the borehole to perform various operations at the well wall or casing A method of opening a window in a casing using a system according to the invention having a milling tool as the operating head, may comprise positioning and anchoring the tool in the casing near to the desired location of the window; rotating the milling tool using the motor; and operating the direction control mechanism so as to displace the rotating milling head away from the axis of the tool against the casing and open a window of predetermined shape and size.

Preferably, this method comprises operating the direction control mechanism to displace the milling tool in axial and azimuthal directions while milling the casing. The method may further comprise, following opening of the window, releasing the anchors and withdrawing of the system from the casing.

One preferred embodiment of the system according to the invention uses controls for the position and direction of a rotating operating head to position the head with respect to an existing window in a casing, to expand anchors to anchor the tool in position, and further to un-anchor and retract and to retrieve a whipstock or a guidestock.

BRIEF DESCRIPTION OF THE DRAWINGS

FIG. 16 illustrates a schematic view of a sixth embodiment of the invention;

FIG. 17 illustrates a schematic view of a seventh embodiment of the invention;

FIGS. 18-20 show schematic views of an eight embodiment of the invention;

FIG. 19 shows a view on A-A of FIG. 18;

FIG. 20 shows the casing in FIGS. 18 and 19 with the embodiment of the invention removed.

DETAILED DESCRIPTION OF THE INVENTION

Figure 1:
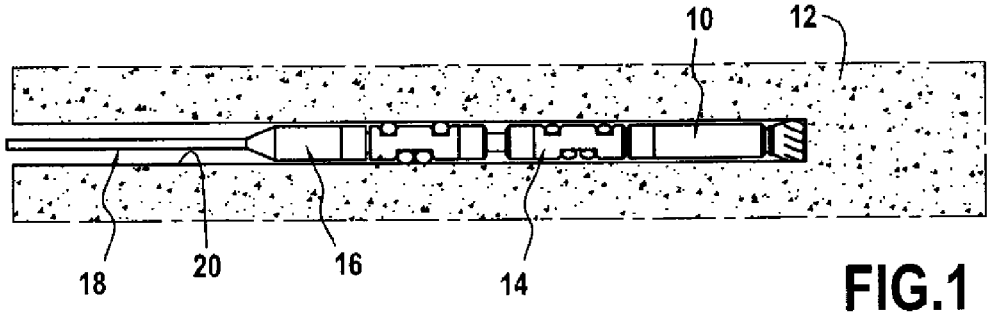
FIG. 1 illustrates a schematic view of a drilling system according to an embodiment of the invention.

FIG. 1 shows the general type of drilling system according to one preferred embodiment of the invention. The system includes a downhole drilling unit comprising a rotary drive system 10 carrying a drill bit 12. A tool 14 including an axial drive system is positioned behind the rotary drive system 10 and connected to the surface via a control section 16 and a non-rotating conveyance 18 such as a wireline cable or a coiled tubing carrying an electric cable.

The rotary drive system 10 includes an electric motor by which the drill bit 12 is rotated. The power of the motor will depend on its size although for many applications, it may be no more than 3 kW.

In use, the drilling system is run into the borehole 20 until the bit 12 is at the bottom. Drilling proceeds by rotation of the bit 12 using the rotary drive system 10 and advancing the bit into the formation by use of the axial drive system in the tool 14. Control of both is effected by the control system 16 which can in turn be controlled from the surface or can run effectively independently.

In one preferred embodiment, the axial drive system comprises a tractor having pairs of anchors using the push-pull principle. This allows dissociation of coiled tubing pulling and drilling, which helps accurate control of the weight on bit. A suitable form of tractor is described in European patent application no. 04292251.8 and PCT/EP04/01167.

FIG. 1 shows the elements of the drilling system in a linear arrangement suitable for drilling straight boreholes. In order to change the trajectory of the borehole, or to drill a new lateral borehole from an existing borehole, it is necessary to displace the bit 12 from the axis of the tool 14. This invention achieves this in one of two ways, known as 'point-the-bit' and 'push-the-bit'.

Figure 2:
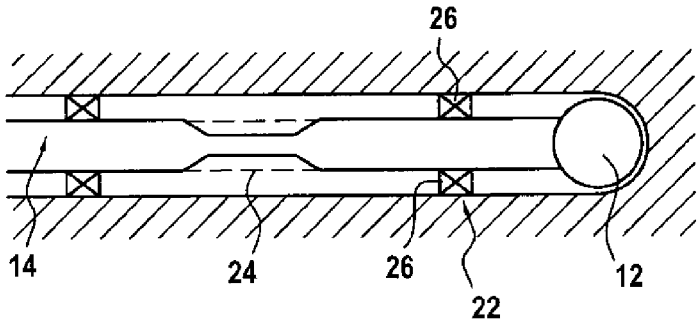
FIGS. 2 and 3 illustrate side and cross-section views of an embodiment of the invention.

In push-the-bit, an asymmetric force is applied to the drilling system to urge the drill bit 12 in the desired direction. FIG. 2 shows a schematic view of such a system according to an embodiment of the invention.

This embodiment uses an anchor-like assembly 22 below the tool 14 and close to the bit 12 to push the bit 12 in the preferred direction. The assembly 22 operates to apply a force that in turn forces the bit 12 to drill in the opposite direction as a function of the force applied. The force required using this method may not need to be large, but may require decoupling the moments from the rest of the tool. This can be achieved, for example, by use of a flex section 24 with a low modulus of rigidity.

Figure 3:
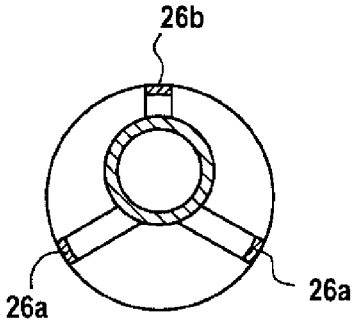

The assembly 22 has at least three skids 26 (at 120°) on the external diameter of the tool that can each be extended separately. The end of each skid in contact with the formation is shaped so as to slide on the borehole wall while drilling progresses. Drilling ahead proceeds by setting the appropriate anchors on the tractor and pushing the drill bit against the reaction provided by the set anchors. To force the bit 12 in any specific direction (over a 360° range), the skids 26 are each extended by a predetermined amount to provide the desired net force in the required direction. In FIGS. 2 and 3, the lower pistons **26*a* are pushed out further (with a higher force) than the upper one 26*b*, thus pushing the bit 12** upwards (therefore preferentially building angle).

It will be appreciated that changes can be made to the system described above. For example, more than three skids can be used in the assembly 22. Also, in the embodiment described above, the rotary drive motor 10 is close to the bit and below the flex section 24. An alternative is to position the motor 10 in the tool 14 above the flex section and drive the bit using a flexible drive shaft.

Figure 5:
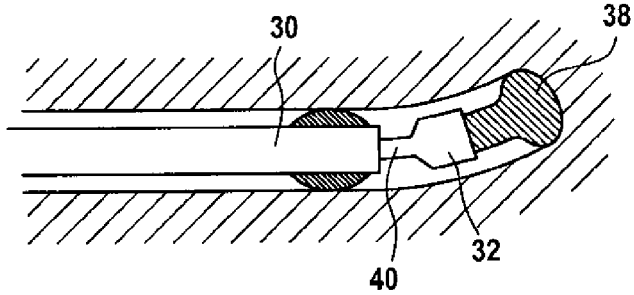
FIGS. 4 and 5 illustrate side and cross-section views of a second embodiment of the invention.
Figure 4:
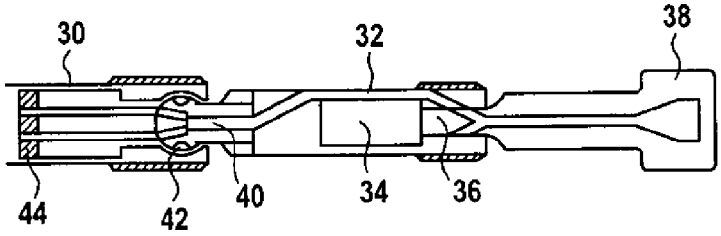

In the point-the-bit approach, an adjustable angle is created between the tool axis and the drill bit axis. This angle would need to be controlled in both azimuthal direction (preferably 0-360°) and axis angle (preferably at least 0-4°) so as to be able to drill up to a desired dogleg curve (e.g. 120°/100 ft). FIGS. 4 and 5 show schematically an embodiment of such a system. An upper tool part 30 is similar to that shown in FIG. 1 and includes an axial drive system (push-pull tractor) with anchors. A lower tool part 32 houses a rotary drilling motor 34, a bit shaft 36, and the bit 38. The lower tool part 32 is linked to the upper tool part 30 by a shaft 40 extending through a universal joint (UJ) 42. The UJ 42 allows reaction torque to be transmitted from the bit 38 to the upper tool part 30 (and eventually the anchors), and axial thrust (WOB) to be transmitted from the tractor to the bit 38. The UJ 42 typically also allows for passage of high-voltage wiring, hydraulic fluid and circulation fluid between the upper tool part 30 and lower tool part 32. A direction control mechanism 44 (described in more detail below) is located in the upper tool part 30 and acts on the shaft 40 to direct the bit 38.

One embodiment of the direction control mechanism comprises a ring-in-ring offsetting mechanism where two offset rings within each other can be rotated to either cancel or add the offsets, therefore allowing for pointing the shaft straight ahead or at any desired angle. The angle then needs to be oriented in the desired direction by rotating the set of rings as an assembly.

Figure 6:
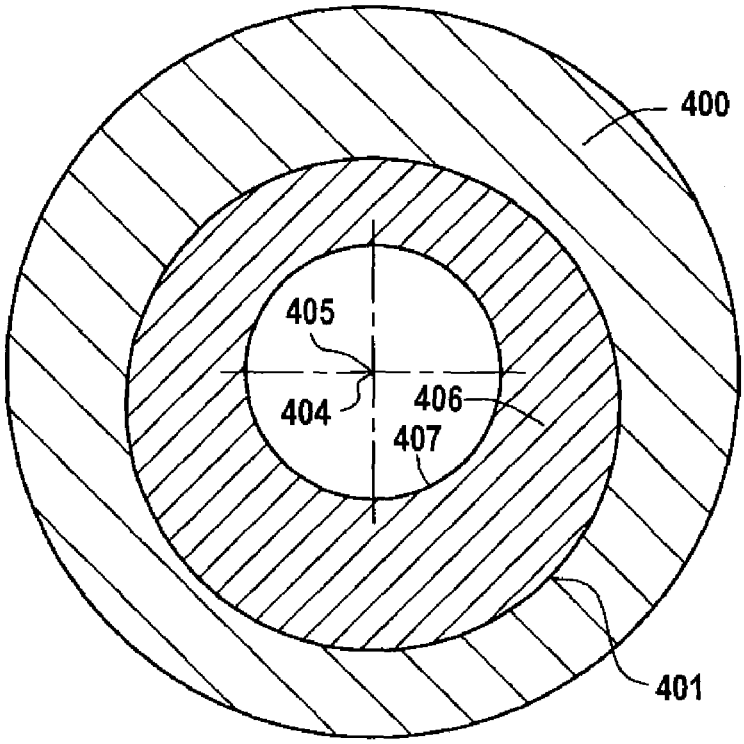
FIGS. 6-9 illustrate sections of a direction control mechanism for use in the embodiment of FIGS. 4 and 5.
Figure 7:
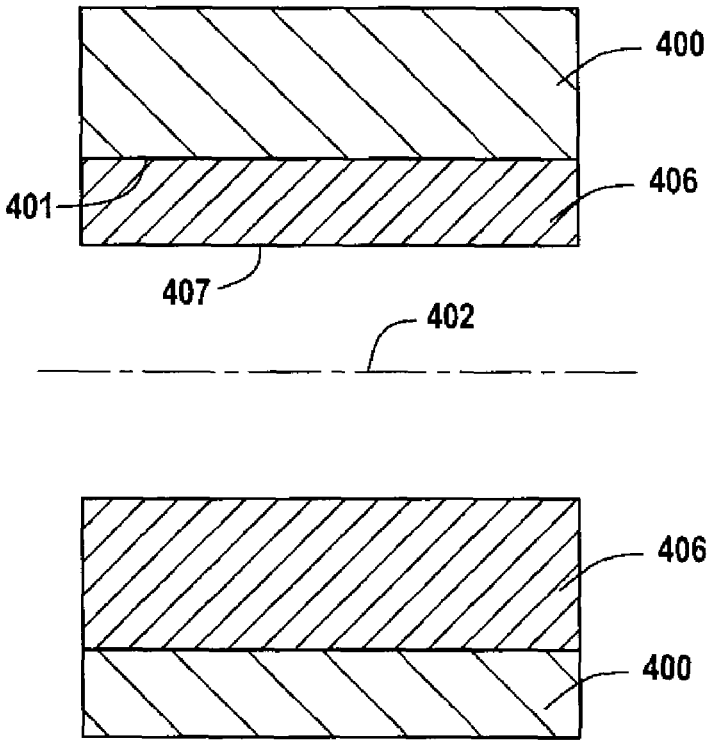

An example of the ring-in-ring mechanism is shown in FIGS. 6-9 (details of the use of such a system in other applications can be found in U.S. Pat. No. 6,092,610, issued Jul. 25, 2000 and assigned to SCHLUMBERGER TECHNOLOGY CORPORATION, which is hereby incorporated by reference. In this embodiment, upper tool part 30 is attached rotationally to an outer ring 400 having an offset internal surface 401, this circular internal surface having a centreline at an offset and at an angle to the outside diameter of an inner ring 406 into which is inserted the end of the shaft 40. In FIG. 6, the offsets from the outer and inner rings subtract, which causes the centre of the shaft axis 402 (aligned to internal diameter 407 of the inner ring 406) to be aligned with the longitudinal axis of the upper tool part 30. Consequently, as depicted in FIGS. 6 and 7, the centre 405 of the inner ring (shaft) 406 is coincident with the centre 404 of the outer ring (upper tool part 30) 404, thereby causing the axis of the bit 38 and lower tool part 32 to be aligned with the upper tool part 30 such that the system drills a straight wellbore.

Figure 8:
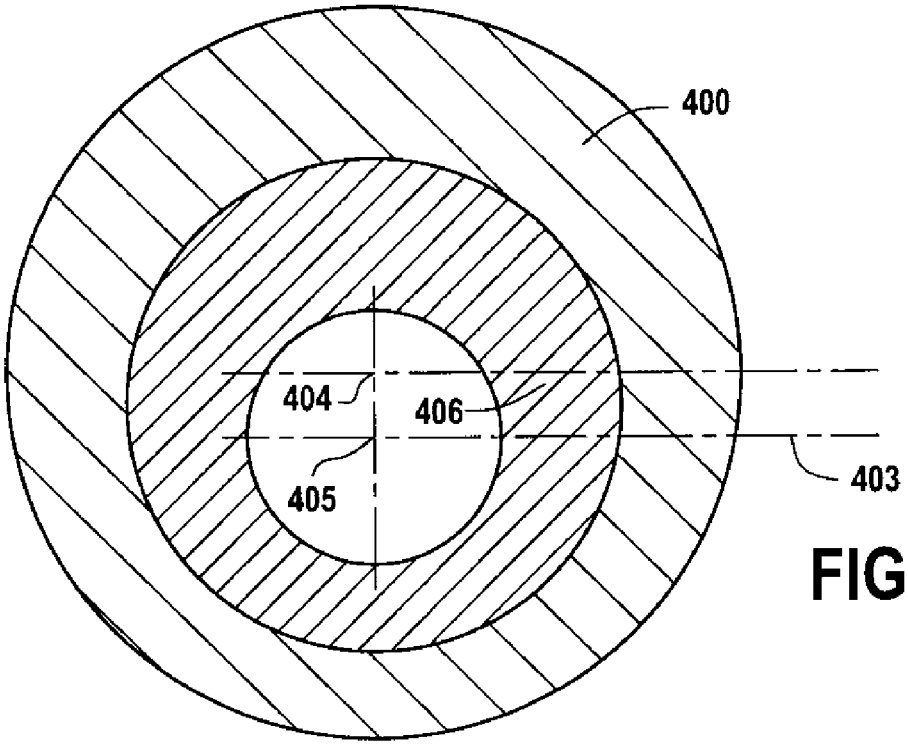
Figure 9:
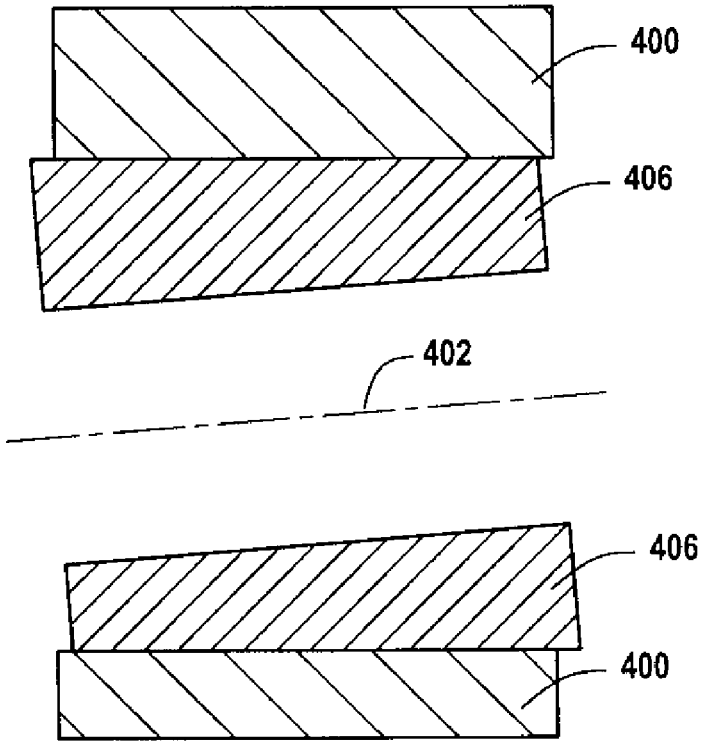

If the inner ring 406 is rotated 180° relative to the outer ring 400 as shown in FIGS. 8 and 9, then the resulting geometry of the outer and inner rings 400, 406 adds the offsets of the outer and inner rings, causing the shaft axis 402 through point 405 to be at the maximum offset 403 with respect to the outer ring 400, thus locating the shaft 40 at its maximum angle with respect to the upper tool part 30 to drill in a desired direction. To achieve a lesser angle of the shaft 40 with respect to the upper tool part 30 than occurs with the ring setting of FIGS. 8 and 9, the positioning rings 400, 406 can have any relative rotational positioning between the ring positions of FIGS. 6 and 7, and the ring positions of FIGS. 8 and 9. Thus, the angled relation of the longitudinal axis of the shaft 40 and thus bit 38 with respect to the longitudinal axis of the upper tool part 30 is variable between 0° and a predetermined maximum angle depending upon the relative positions of the positioning rings 400, 406. These rings can be rotated with respect to each other by various mechanical or electrical means, such as a geared motor.

Once a desired angle of bit axis has been achieved by relative rotation of the two rings, azimuthal direction is determined by rotating both rings together while maintaining their relative positions.

Figure 10:
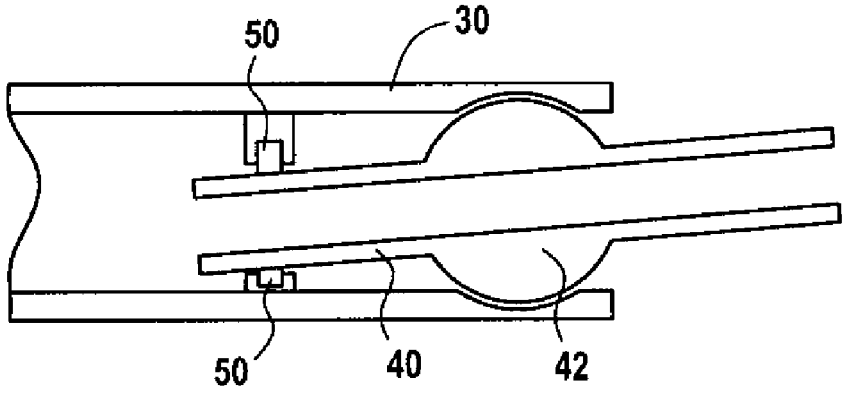
FIGS. 10 and 11 illustrate side and cross-section views of a third embodiment of the invention.
Figure 11:
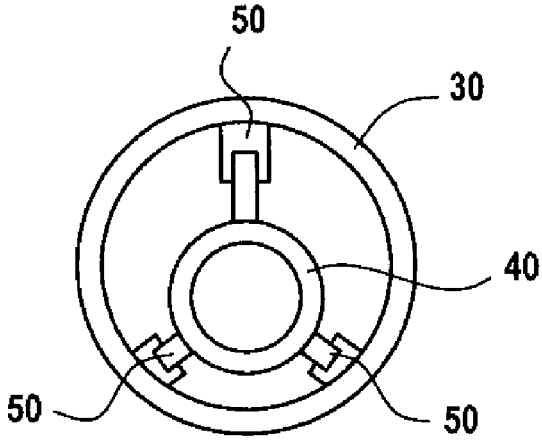

Another mechanism for offsetting the end of the shaft involves a plurality of radial pistons 50 (at least three for full positional selection) as depicted in FIGS. 10 and 11. The pistons of this mechanism operate in a similar way to the skids of the push-the-bit embodiment described above, the UJ 42 acting to reverse the effect at the bit 38 (pushing the end of the shaft 40 down causes the bit 38 to be raised).

Figure 12:
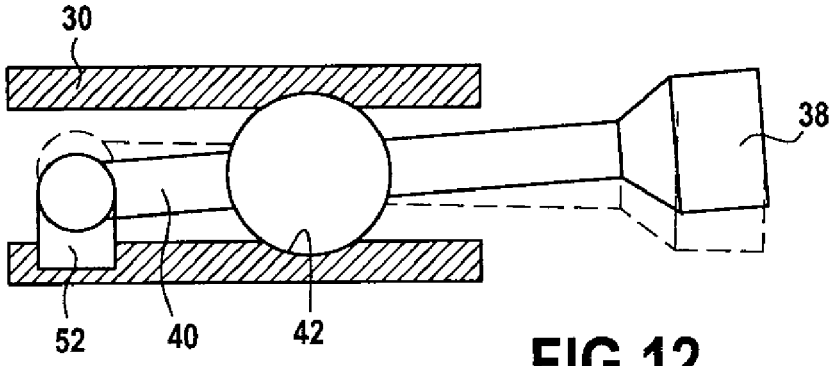
FIGS. 12 and 13 illustrate side and cross-section views of a fourth embodiment of the invention.
Figure 13:
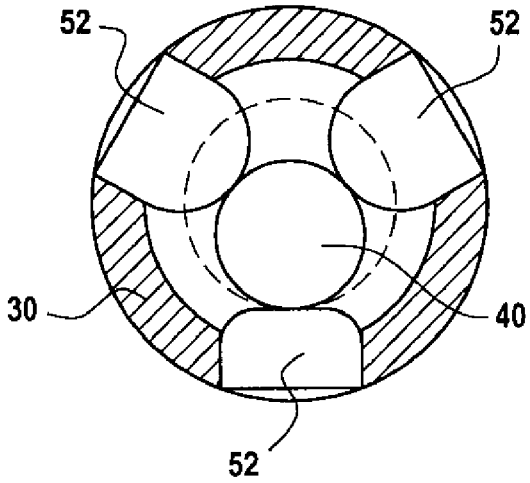

A variation of this mechanism involves the use of internal inflatable bladders 52 in the place of the pistons as is shown in FIGS. 12 and 13. The inflation and deflation of the bladders 52 allows the shaft 40 to be moved to the desired direction and angle. Measurement means may be required to determine the position of the offset since the movement caused by the bladders is not as controllable as with the pistons.

Figure 14:
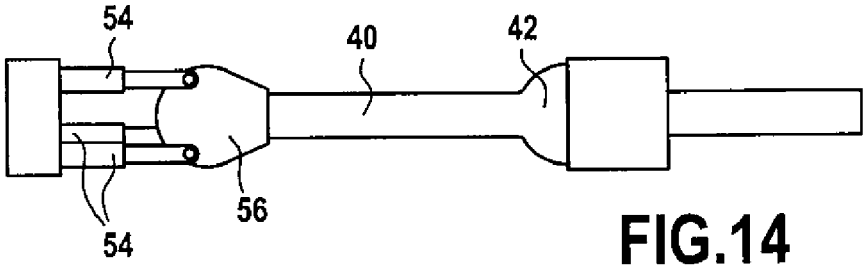
FIGS. 14 and 15 illustrate side and cross-section views of a fifth embodiment of the invention.
Figure 15:
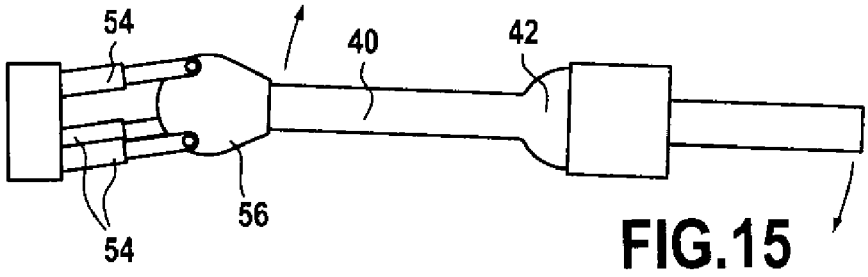

A further embodiment of a direction control mechanism comprises the use of three axial pistons 54 connected to a head 56, which in turn orients the shaft 40, as is shown in FIGS. 14 and 15. In this mechanism, extension or retraction of the pistons 54 to different degrees will have the effect of rotating the head and thus deflecting the shaft 40 (see, for example, FIG. 15).

By selectively activating (and measuring) the displacement of the three pistons 54, the direction and inclination of the shaft 40 can be changed. A typical offset required could be for example 5°, in which case the displacement of the three pistons would typically be in the order of a few millimeters for wireline drilling systems.

A further embodiment of the direction control mechanism dissociates the two steering dimensions, allowing for better control of each, and easier packaging. FIG. 16 shows the steering mechanism kinematics chain.

This mechanism combines a translation and a rotation. To define the direction, an orientation sleeve 58 is oriented (0°-360°) about its axis. A bore 60 has been machined in this sleeve with an angle $\alpha$. Once the orientation has been chosen, the sleeve 58 can be moved forward or backward, using piston 62, to set the shaft inclination. The shaft is connected to the tool 30 with an indexed universal joint 42. Such a system presents the advantages to provide a good orientation in all directions (0-360°) and an accurate bend angle selection.

It will be recalled that the point-the-bit approach requires control of the adjustable angle in azimuth, i.e. rotation. By limiting the rotation mechanism (sleeve 58) to 0°-360°, electrical wiring can simply be lead past the translation mechanism (piston 62) to the rotation mechanism, provided enough length is allowed for a full 360° twist. Alternatively, if a 'slip-ring' is used to get power and communication around translation mechanism 62, then the rotation mechanism 58 can make an infinite number of turns with respect to the tool.

Alternatively, if the electrical wiring is led past the translation mechanism (piston 62) to the rotation mechanism through centre bores in piston 62, in sleeve 58 and in shaft 40, then the rotation mechanism 58 can make an infinite number of turns with respect to the tool. For example, in an embodiment without a slip-ring or wiring going through centre bores (through-wired), if the rotation mechanism is already at 360° and the requirement is to turn another 20° to the right, the rotational mechanism would need to turn *left* by 340° (360-20) to the new desired angle. This would increase the tortuosity of the drilled hole and increase the time required for a minor directional change.

The management of the orientation and inclination is fully independent and can be driven by separate (electrical and/or hydraulic) systems. Selecting a low inclination angle in the sleeve generates an easy activation management, as the piston 62 can have a long stroke. This method has the mechanical advantage to generate a high side force on the lower end by design; allowing to apply a high bit side force, or to lift additional components below the steering mechanism.

FIG. 17 shows a further embodiment of the steering mechanism for use in the invention. In this case, the mechanism comprises three axial piston and cylinder arrangements 70 (only one shown for clarity) arranged at 120° positions around the tool axis. The cylinders are connected to the lower tool part 30 and the pistons arranged to act in an axial direction, each connecting to an associated wedge 72 (of inclination $\beta$) which acts on the end of the shaft 40 which in turn extends through a universal joint 42 in a similar manner to the embodiments of FIGS. 12 and 16. By adjusting the displacement of each wedge 72, the orientation of the shaft 40 can be adjusted.

With all the embodiments described above, the drill bit can be replaced by a milling tool 102 to cut window in a casing as depicted in FIGS. 18-20. The system is run into the casing 100. The position of the mill 102 is adjusted using the direction control mechanism and the tractor during the milling operation in order to cut the casing to open a window 103 of any desired shape and dimension while following a chosen trajectory and while keeping a depth of cut adapted to the cutting parameters of the mill. FIG. 20 shows the window 103 cut in the casing (the system is omitted for clarity).

In order to stabilize the tool during the milling process, the direction control mechanism can be used to apply a contact pad against the inner bore of the casing with a controlled force to avoid vibrations and to set a precise depth of cut. Such a system present the advantages of adapting the shape and dimension of the window to any specific need as for providing a smooth transition from the casing to the lateral borehole.

Figure 21:
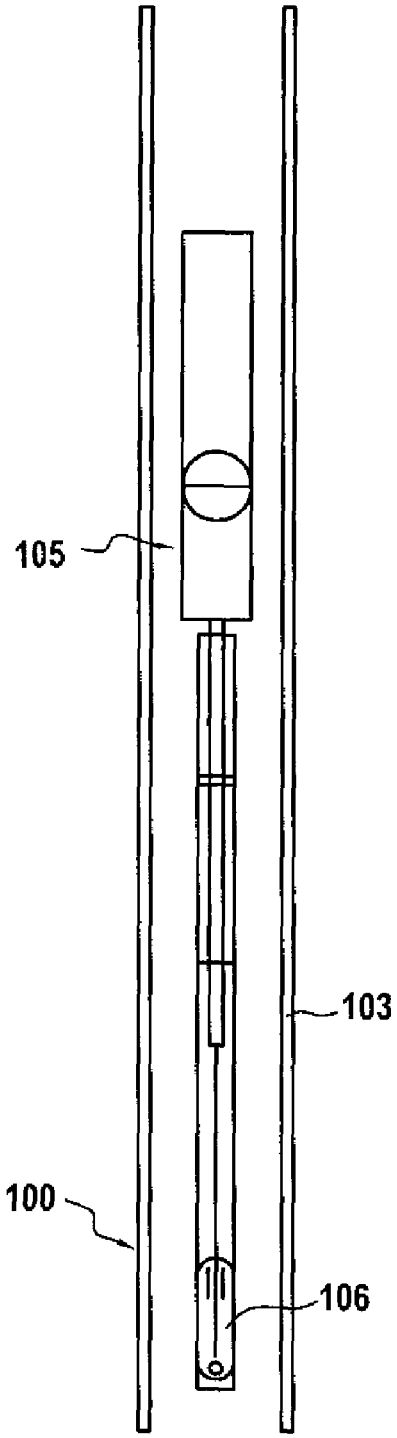
FIGS. 21-24 show schematic views of a ninth embodiment of the invention.
Figure 22:
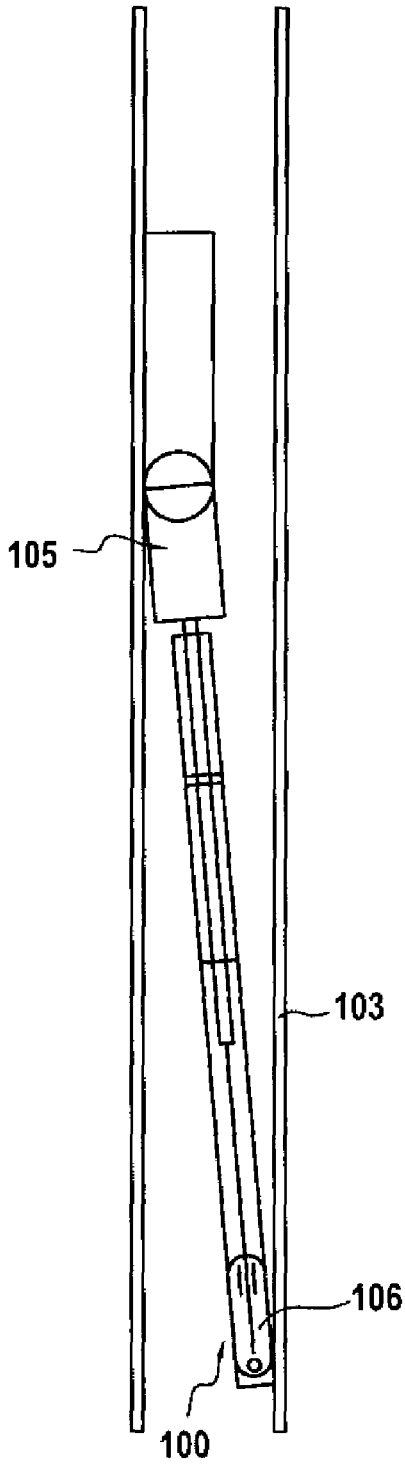
Figure 23:
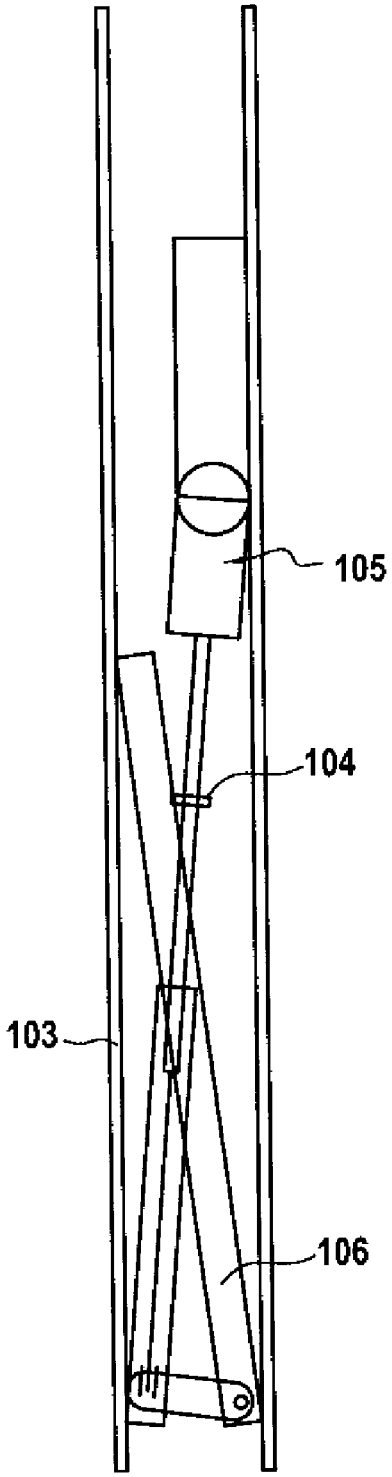
Figure 24:
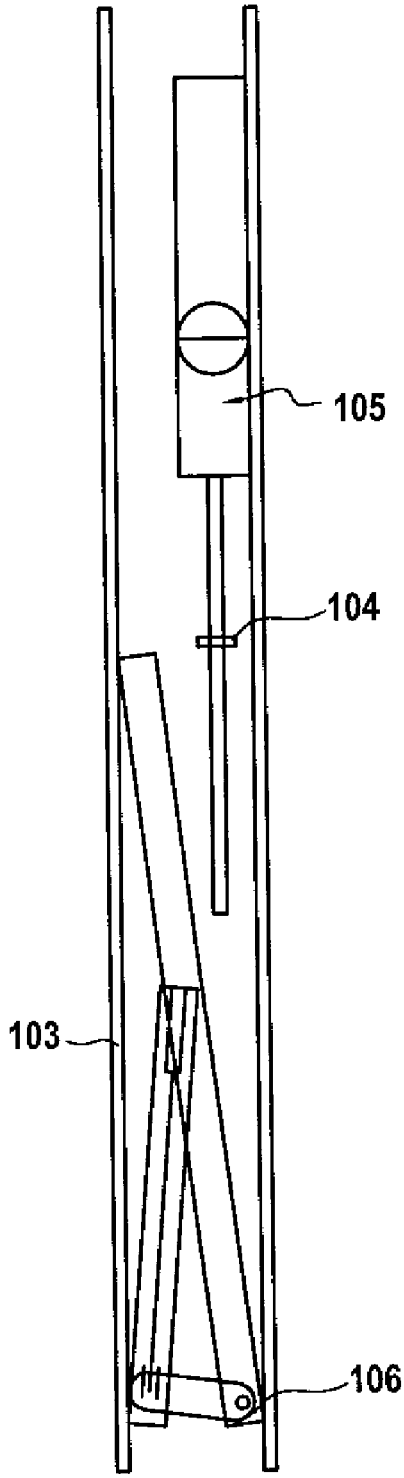

In another embodiment, the drill bit can be replaced by a setting tool in order to install a whipstock or a guidestock as depicted in FIGS. 21-24. The system is run into the casing 100 in front of an open window 103 (FIG. 21). The direction control mechanism, the tractor and the rotating head 105 are used to position the bottom of the whipstock 106 at the lower end of the window 103 (FIG. 22). The tool is then used to deploy and to anchor the whipstock 106 (FIG. 23) followed by unlatching the whipstock 106 from the lock 104 of the setting tool (FIG. 24). The reverse sequence of operation is used to retrieve the whipstock. Such a system allows the setting of a guidestock or a whipstock in a precise position and orientation with respect to an already existing window.

While the embodiments described above relate to some specific applications, it will be understood that the drill bit can be replaced with other operating heads while still delivering a similar effect. For example, orienting system can be used to machine an internal bore profile or a plug, to remove scale deposits in a cased well, to set a packer, a plug or a valve, to activate a valve or a choke or to position a nozzle to perform cleaning by high pressure or high flow jetting or removal. In all cases, the accurate directional control permitted by the invention can be used to full effect.

Further changes can be made without departing from the scope of the invention.

The invention claimed is:

1. A well service system, comprising:

a non-rotating conveyance system;

a tool connected to the non-rotating conveyance system and including anchors by which the tool can be anchored in position when located in a borehole;

an operating head connected to the tool;

a motor for rotating the operating head;

a directional control system interposed between the tool and the operating head, wherein the directional control system comprises a universal joint in the tool through which the operating head is connected and a direction control mechanism in the tool which is operable to adjust the angle of the operating head axis relative to the tool axis and to adjust the azimuthal direction of the operating head axis; and, a shaft extending between the operating head and the direction control mechanism through the universal joint; wherein: in use, with the system located in a borehole, the directional control system can be operated so as to displace the operating head away from the axis of the borehole to perform various operations at the well wall or casing.

2. The well service system as claimed in claim 1, wherein the direction control mechanism comprises a pair of inter-engaging eccentric rings, one of which connects to the tool and the other of which connects to the shaft, relative rotation of the rings allowing adjustment of the angle of the operating head axis, and co-rotation allowing adjustment of the azimuthal direction of the operating head axis.

3. The well service system as claimed in claim 2, wherein a first, outer ring is connected to the tool, and a second, inner ring that sits inside the first, outer ring and is connected to the shaft.

4. The well service system as claimed in claim 1, wherein the direction control mechanism comprises a plurality of pistons which act on a head connected to the shaft, the pistons being operable to adjust the angle of the operating head axis relative to the tool axis and to adjust the azimuthal direction of the operating head axis.

5. The well service system as claimed in claim 4, wherein the pistons act in a radial direction to adjust the position of the shaft.

6. The well service system as claimed in claim 1, wherein the direction control mechanism comprises at least three inflatable bladders positioned inside the tool around the shaft, the bladders being inflatable so as to act on the shaft and adjust its position.

7. The well service system as claimed in claim 1, wherein the direction control mechanism comprises separate mechanisms to adjust the angle of the operating head axis relative to the tool axis and to adjust the azimuthal direction of the operating head axis.

8. A well service system, comprising:

a non-rotating conveyance system;

a tool connected to the non-rotating conveyance system and including anchors by which the tool can be anchored in position when located in a borehole;

an operating head connected to the tool;

a motor for rotating the operating head, wherein the motor for rotating the operating head is positioned between the operating head and the tool; and a directional control system interposed between the tool and the operating head; wherein the directional control system comprises a universal joint in the tool through which the operating head is connected or a flex section having a lower modulus of rigidity than the tool, and further wherein, in use, with the system located in a borehole, the directional control system can be operated so as to displace the operating head away from an axis of the tool to perform various operations at the well wall or casing.

9. A well service system, comprising:

a non-rotating conveyance system;

a tool connected to the non-rotating conveyance system and including anchors by which the tool can be anchored in position when located in a borehole;

an operating head connected to the tool;

a motor for rotating the operating head; and a directional control system interposed between the tool and the operating head; wherein the tool comprises an axial drive system for applying thrust to the operating head and the directional control system comprises a universal joint in the tool through which the operating head is connected or a flex section having a lower modulus of rigidity than the tool, and further wherein, in use, with the system located in a borehole, the directional control system can be operated so as to displace the operating head away from an axis of the tool to perform various operations at the well wall or casing.

10. The well service system as claimed in claim 9, wherein the axial drive system comprises a push-pull tractor having pairs of anchors that are alternately deployed as the tractor moves along the borehole.

11. The well service system as claimed in claim 10, wherein the anchors of the push-pull tractor provide the anchors by which the tool is located in position in the borehole.

12. A method of opening a window in a casing, wherein the method comprises the steps of:

using a well service system, comprising:

a non-rotating conveyance system;

a tool connected to the non-rotating conveyance system and including anchors by which the tool can be anchored in position when located in a borehole;

an operating head connected to the tool;

a motor for rotating the operating head; and a directional control system interposed between the tool and the operating head, wherein the directional control system comprises a universal joint in the tool through which the operating head is connected or a flex section having a lower modulus of rigidity than the tool; wherein, in use, with the system located in a borehole, the directional control system can be operated so as to displace the operating head away from the an axis of the tool to perform various operations at the well wall or casing; wherein using the well system comprises:

(a) positioning and anchoring the tool in the casing near to the desired location of the window;

(b) rotating the operating head using the motor; and (c) operating the directional control mechanism so as to displace the operating head away from the axis of the tool against the casing and open a window of predetermined shape and size.

13. The method as claimed in claim 12, wherein the operating head of the well service system comprises a milling tool.

14. The method as claimed in claim 13, further comprising operating the directional control mechanism to displace the milling tool in axial and azimuthal directions while milling the casing.

15. The method as claimed in claim 12, further comprising, releasing the anchors and withdrawing of the system from the casing.

16. A method of opening a window in a casing, wherein the method comprises the steps of:

using a well service system, comprising:

a non-rotating conveyance system;

a tool connected to the non-rotating conveyance system and including anchors by which the tool can be anchored in position when located in a borehole;

an operating head connected to the tool;

a motor for rotating the operating head; and a directional control system interposed between the tool and the operating head; wherein, in use, with the system located in a borehole, the directional control system can be operated so as to displace the operating head away from the axis of the borehole to perform various operations at the well wall or casing; wherein using the well system comprises:

(a) positioning and anchoring the tool in the casing near to the desired location of the window;

(b) rotating the operating head using the motor; and (c) operating the directional control mechanism so as to displace the operating head away from the axis of the tool against the casing and open a window of predetermined shape and size, wherein the well service system further comprises controls for the position and direction of a rotating operating head, and the method further comprises the steps of using the controls to position the operating head with respect to an existing window in a casing, to expand anchors and set a whipstock or guidestock to anchor the tool in position, and further to unanchor and retract and to retrieve the whipstock or guidestock.

* * * * *